US010633991B2

(12) United States Patent
Kang et al.

(10) Patent No.: US 10,633,991 B2
(45) Date of Patent: Apr. 28, 2020

(54) NOZZLE BOX ASSEMBLY

(71) Applicant: DOOSAN HEAVY INDUSTRIES & CONSTRUCTION CO., LTD., Gyeongsangnam-do (KR)

(72) Inventors: Dongwoo Kang, Gyeonggi-do (KR); Dong Il Kim, Gyeonggi-do (KR); Haesang Jeong, Gwangju (KR); Cheolhong Kim, Gyeonggi-do (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 533 days.

(21) Appl. No.: 15/227,742

(22) Filed: Aug. 3, 2016

(65) Prior Publication Data

US 2017/0204733 A1 Jul. 20, 2017

(30) Foreign Application Priority Data

Jan. 15, 2016 (KR) ..... 10-2016-0005599
Jun. 14, 2016 (KR) ..... 10-2016-0073665

(51) Int. Cl.
*F01D 9/04* (2006.01)
*F01D 25/24* (2006.01)

(52) U.S. Cl.
CPC ..... *F01D 9/047* (2013.01); *F01D 9/041* (2013.01); *F01D 25/246* (2013.01); *F05D 2220/31* (2013.01); *F05D 2230/232* (2013.01); *F05D 2240/12* (2013.01); *F05D 2240/128* (2013.01); *F05D 2260/31* (2013.01)

(58) Field of Classification Search
CPC ..... F01D 9/04–048
See application file for complete search history.

(56) References Cited

U.S. PATENT DOCUMENTS 1,118,352 A * 11/1914 Junggren ..... F01D 9/042 415/209.4
3,758,229 A * 9/1973 Price ..... F01D 9/047 415/185

(Continued)

FOREIGN PATENT DOCUMENTS

GB 389308 * 6/1931
GB 1073415 A 6/1967

(Continued)

OTHER PUBLICATIONS

European search report dated Jun. 6, 2017 in corresponding European patent application 16183851.1.

(Continued)

*Primary Examiner* — Igor Kershteyn
*Assistant Examiner* — Brian O Peters
(74) *Attorney, Agent, or Firm* — Invenstone Patent, LLC

(57) ABSTRACT

A nozzle box assembly includes steam inlets, a torus part, and a steam path ring. Working steam is supplied through the steam inlets. The torus part is connected to the steam inlets so as to form an annular steam path and having an opening portion, in which a part of the annular steam path is opened. The steam path ring is connected to the opening portion so as to provide a path, which is connected to a stage, and provided with a plurality of vanes. The steam path ring is directly connected to the opening portion.

19 Claims, 9 Drawing Sheets

(56) References Cited

U.S. PATENT DOCUMENTS

| | | | | |
|---|---|---|---|---|
| 5,259,727 | A * | 11/1993 | Quinn | B23P 6/005 29/402.08 |
| 5,392,513 | A * | 2/1995 | Mazzola | B23P 6/005 228/119 |
| 6,196,793 | B1 * | 3/2001 | Braaten | F01D 9/047 415/191 |
| 6,754,956 | B1 | 6/2004 | Tomko et al. | |
| 9,322,089 | B2 * | 4/2016 | Biondo | C22C 19/03 |
| 2006/0182625 | A1 | 8/2006 | O'Clair et al. | |
| 2008/0102296 | A1 * | 5/2008 | Ghasripoor | C23C 14/0641 428/469 |
| 2012/0070269 | A1 | 3/2012 | Mizutani | |
| 2014/0363281 | A1 | 12/2014 | Dorow | |

FOREIGN PATENT DOCUMENTS

| | | | |
|---|---|---|---|
| JP | 53-79906 | U | 7/1978 |
| JP | 57-070903 | A | 5/1982 |
| JP | 58-210303 | A | 12/1983 |
| JP | 59-015603 | A | 1/1984 |
| JP | 61-138802 | A | 6/1986 |
| JP | 06-307203 | A | 11/1994 |
| JP | 08-014003 | A | 1/1996 |
| JP | 2004-183662 | A | 7/2004 |
| JP | 2010-038161 | A | 2/2010 |
| JP | 2010-209857 | A | 9/2010 |
| KR | 10-0022523 | A | 3/2008 |
| KR | 10-1401140 | B | 5/2014 |

OTHER PUBLICATIONS

Korean Office Action dated Jul. 20, 2017 in corresponding Korean patent application 10-2016-0073665.

Japanese Office Action dated Jun. 6, 2017 in corresponding Japanese patent application 2016-157411.

Korean Prior Art Search Report in corresponding Korean patent application 10-2016-0005599.

* cited by examiner b)

NOZZLE BOX ASSEMBLY

CROSS-REFERENCE TO RELATED APPLICATION(S)

This application claims priority to Korean Application No. 10-2016-0005599, filed Jan. 15, 2016, and Korean Application No. 10-2016-0073665, filed Jun. 14, 2016, the contents of each of which are incorporated herein in their entirety.

BACKGROUND

The present disclosure relates to a nozzle box assembly and, more particularly, to a nozzle box assembly provided to the inlet of the first stage of a steam turbine so as to inject the steam of high temperature and high pressure to the first stage.

A related art nozzle box assembly for a steam turbine, as shown in FIG. 1 and FIG. 2, typically includes three constituent elements, that is, a torus 14, a bridge ring 16 and a steam path ring 12. Each of the constituent elements is prepared as a 180° segment in the initial stage and then the constituent elements are welded in sequence so as to form two nozzle box halves 18. FIG. 1 and FIG. 2 show one of the nozzle box halve 18, wherein the other one, which is not shown, also has the same shape and structure.

Next, the two halves 18 are joined together along a horizontal center line so as to form a nozzle box assembly for a steam turbine. Each of the nozzle box halves 18 includes one or more steam inlets 10, which are integrally formed with the torus 14. The steam inlets 10 are connected to the torus 14 on a plane surface, which is perpendicular to the rotation shaft of the turbine.

During the operation of the steam turbine, steam from a steam supply source such as a boiler and the like is introduced through the steam inlets 10 and flows in the torus 14. The flow direction of the steam is typically changed to the axial direction such that the steam flows through the annular opening of the bridge ring 16 to the inside of the steam path ring 12. The steam path ring 12 is provided with a series of nozzles, including airfoil vanes 13 for directing the steam flow.

The related art nozzle box assembly as described above essentially includes a bridge ring 16 for connecting the torus 14 to the steam path ring 12. That is, it is necessary to interpose the bridge ring 16 between the torus 14 and the steam path ring 12 in order to connect the torus 14, which has an internal space in the shape of a circular cross-section, and the steam path ring 12, which is extended long in the rotation shaft direction of the turbine, with a smoothly curved surface. The smoothly curved surface connection formed by the bridge ring 16 smoothly induces the flow of the steam, which is introduced through the steam inlets 10, in a direction along the steam path ring 18, thereby serving to improve the flow efficiency.

As described above, the bridge ring has been applied in order to improve the flow characteristics of the steam, in which steam flow direction is rapidly changed. However, the bridge ring becomes a factor of the increase of a welding portion between the torus and the steam path ring, thereby resulting in the complicated manufacturing procedure while increasing manufacturing costs.

BRIEF SUMMARY

Accordingly, the present disclosure has been made to solve the above-mentioned problems occurring in the related arts, and it is an objective of the present disclosure to provide a new nozzle box assembly, in which the structure of a bridge ring, which has been essentially provided to a related art nozzle box, is removed so as to promote the efficiency of manufacturing procedure and provide excellent efficiency without such a bridge ring, higher than that of the related art under the operation condition of high temperature and high pressure.

In an example, according to the present disclosure, there is provided a nozzle box assembly, including: steam inlets, through which working steam is supplied; a torus part connected to the steam inlets so as to form an annular steam path and having an opening portion, in which a part of the annular steam path is opened; and a steam path ring connected to the opening portion so as to provide a path, which is connected to a stage, and provided with a plurality of vanes, wherein the steam path ring is directly connected to the opening portion.

The torus part has a front surface, an upper inner surface, a lower inner surface and a rear surface with respect to a cross-section of the annular steam path, and the upper inner surface and the lower inner surface have straight sections of a predetermined length.

Herein, it is preferable that the straight sections of a predetermined length, which are included in the upper inner surface and the lower inner surface, are respectively formed in the range of 20~50% of the entire lengths of the upper inner surface and the lower inner surface.

Further, the straight sections of a predetermined length may be designed to be increased or decreased in inverse proportion to a radius of curvature, which is formed by the rear surface of the torus part.

In addition, the front surface may have an upper joint surface and a lower joint surface, which are coupled with the steam path ring, such that the end portion of the upper joint surface is positioned to be adjacent to the rear surface more than the end portion of the lower joint surface.

Herein, it is preferable that a horizontal interval between the upper joint surface and the lower joint surface is to be 1/100 or more and 1/50 or less of the length of the upper inner surface.

Further, the front surface may have a straight section of a predetermined length between the opening portion and the upper inner surface or between the opening portion and the lower inner surface.

In addition, the steam path ring includes an upper body and a lower body, and the inner surface of the upper body may have a stepped portion, which becomes narrow towards the front surface opening portion, through which the working steam is discharged.

According to an embodiment of the present disclosure, the torus part and the steam path ring may be coupled with each other by welding.

Herein, it is feasible that the torus part and the steam path ring form an upper joint surface and a lower joint surface, which are coupled with each other by welding, and torus part side welding surfaces and steam path ring side welding surfaces of the upper joint surface and the lower joint surface may form an angle in the range of 35~45 degrees with each other.

Further, an upper horizontal angle formed by the upper joint surface may be an angle in the range of 35~45 degrees.

In addition, a lower horizontal angle formed by the lower joint surface may be an angle in the range of 40~50 degrees.

According to another embodiment of the present disclosure, the front surface of the torus part and the rear surface of the steam path ring may be respectively provided with a plurality of bolting holes, into which bolts are coupled such that the torus part and the steam path ring are coupled with each other.

Further, according to still another embodiment of the present disclosure, it is feasible that the vane of the steam path ring is formed in the shape of a plurality of divisions, which is spaced from each other at a predetermined circumference angle, and includes an upper holder part and a lower holder part such that the upper and lower end portions of the vane divisions are fixed to the steam path ring, and the upper holder part and lower holder part are fitted and fixed on guide parts, which are provided to the upper body and the lower body of the steam path ring in the circumferential direction.

Meanwhile, according to a further embodiment of the present disclosure, the torus part and the steam path ring may respectively include flanges at connection portions thereof such that the flanges are fixed with each other by bolting.

Further, the nozzle box assembly, according to the present disclosure, may further include a retaining ring such that the retaining ring comes into close contact with the outside or the inside of the torus part so as to encompass the torus part.

The retaining ring may be formed in the shape of at least two or more divisions such that the divided end portions are connected to each other so as to encompass the torus part.

The nozzle box assembly according to the present disclosure may promote the manufacturing efficiency thereof and reduction of manufacturing costs by removing the structure of a bridge ring.

Further, by designing the front surface portion of the torus part into a straight shape, a structure is provided such that the steam path ring can be directly connected to this torus part. Even though bad influences may be possibly influenced on steam flow characteristics by the straight portion of the front surface, such bad influences are offset by the straight sections provided to the inner surfaces of the torus part at the upper and lower sides thereof, thereby maintaining steam flow efficiency to be equal to or higher than that of the prior art. Therefore, according to the nozzle box assembly of the present disclosure, the bridge ring can be effectively removed without the concern of performance deterioration.

In addition, as a result of the removal of the bridge ring, it is possible to provide a structure, in which the torus part and the steam path ring are coupled with each other by bolting instead of welding. Therefore, by avoiding the welding work requiring high level working skill, it is possible to obtain lots of advantages in terms of manufacture, such as resolving the problems of the abandon of products, rework or non-uniform product quality due to welding failure, omitting nondestructive inspections and the like.

Meanwhile, by providing the vane as a divisional body, it is possible to promote high efficiency of manufacturing procedure, compared with the related art, in which the path ring and the vane are integrally formed through cutting process.

BRIEF DESCRIPTION OF THE DRAWINGS

The above and other objects, features and advantages of the present disclosure will be apparent from the following detailed description of the preferred embodiments in conjunction with the accompanying drawings, in which.

EXPLANATION OF REFERENCE NUMERALS IN DRAWINGS

Figure 1:
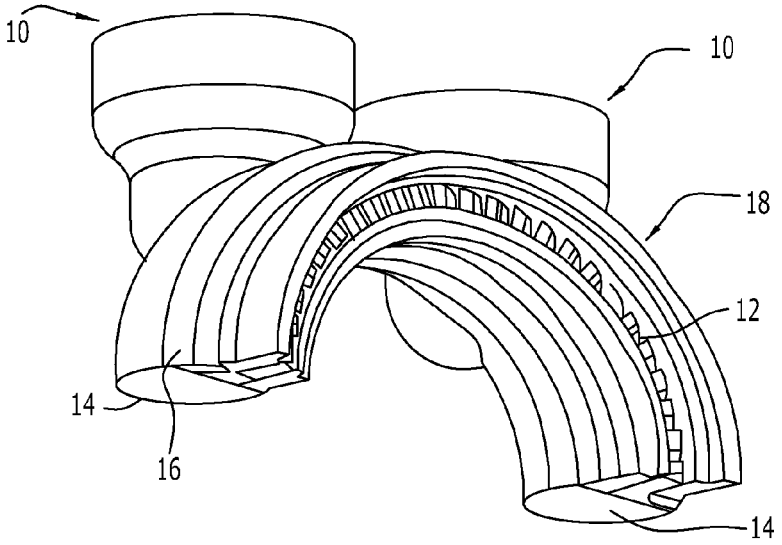
FIG. 1 is a perspective view of a related art nozzle box assembly.
Figure 2:
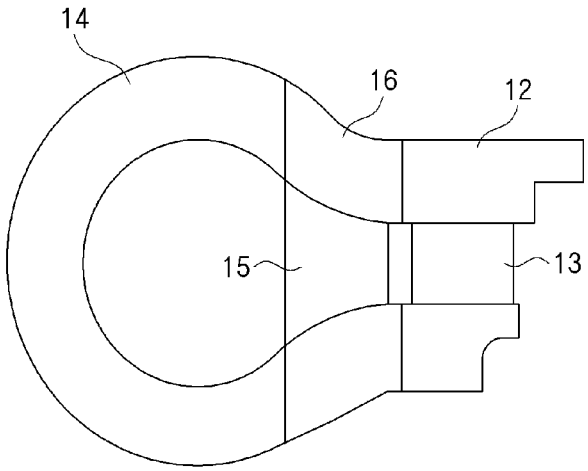
FIG. 2 is a cross-sectional view of the related art nozzle box assembly, in which a torus part and a steam path ring are coupled with each other.

| | |
|---|---|
| 50: steam inlets | 100: steam path ring |
| 101: upper body | 102: lower body |
| 110: vane | 120, 121: flange |
| 130: guide part | 200: torus part |
| 201: rear surface | 202: upper inner surface |
| 203: lower inner surface | 204: front surface |
| 210: front surface end portion | |
| 211: flange | |
| 300, 310: welding part | 320: bolt |
| 400: divisional body | 410: vane |
| 420: upper holder part | 430: lower holder part |
| 510: upper retaining ring | |
| 520: lower retaining ring | |

DETAILED DESCRIPTION

Hereinafter, with reference to the attached drawings, preferred embodiments of the present disclosure will be described in detail. In connection with adding reference signs to the constituent elements in each of the drawings, the same constituent elements have the same reference numerals as far as possible even though they are illustrated in different figures. Further, in the following description of embodiments of the present invention, the detailed description of known functions and configurations will be omitted if those descriptions are determined to interfere with the understanding of the embodiments of the present disclosure. In addition, the terms such as first, second, A, B, a, b and the like can be used in explaining the constituent elements of the example embodiments of the present invention. These terms are simply used to distinguish corresponding constituent elements from other constituent elements but not intended to limit the nature of the corresponding component elements by the terms. Additionally, it should be also understood that the expression that some component is "connected", "coupled" or "linked" to another component means that some component is directly connected to another component or is indirectly "connected", "coupled" or "linked" to another component through a further component interposed between each of the components.

Figure 3:
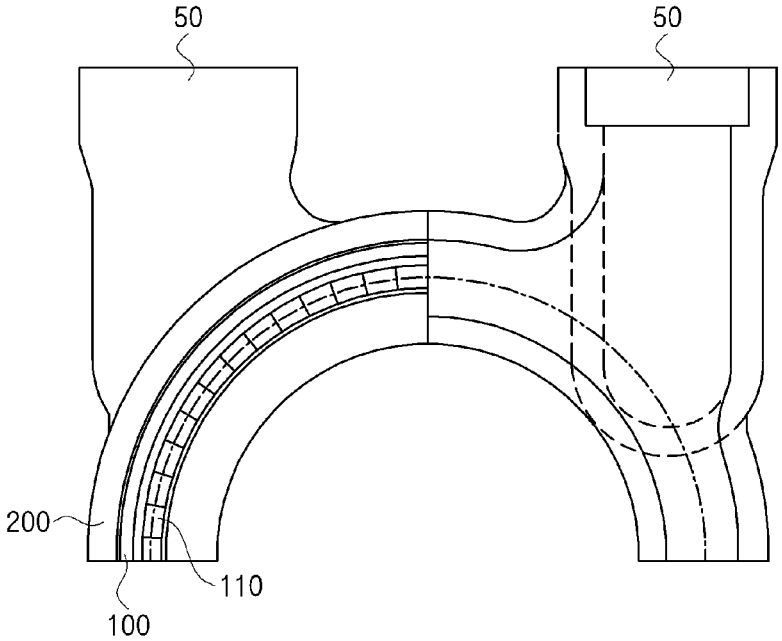
FIG. 3 is a schematic view of a nozzle box assembly according to an embodiment of the present disclosure.

FIG. 3 is a schematic view showing a nozzle box assembly according to an embodiment of the present disclosure.

As shown in FIG. 3, two steam inlets 50, which are extended in the vertical direction, are connected to a torus part 200. The annular torus part 200 and the steam inlets 50 are formed to be integral with each other, and a steam path ring 100 is provided to a front surface at one side of the torus part 200, which is in an annular shape.

Figure 4:
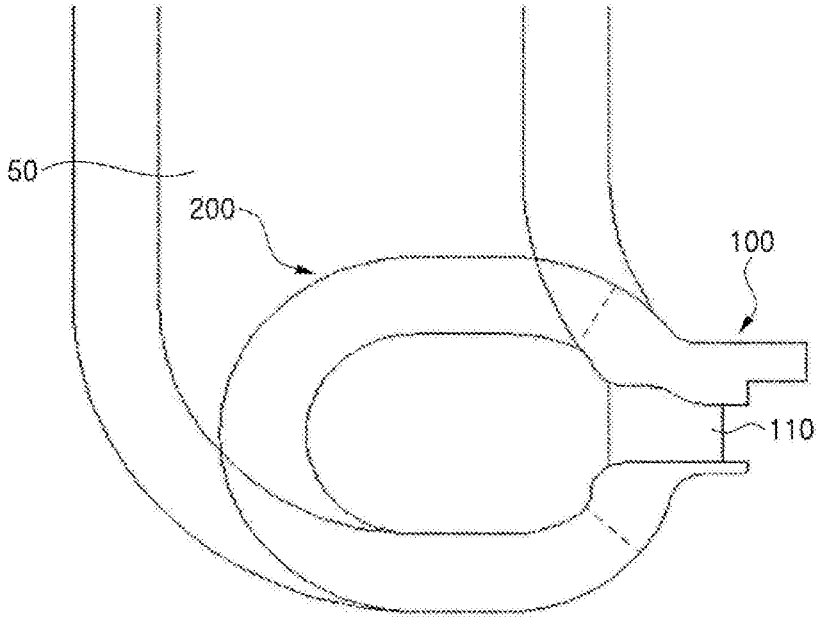
FIG. 4 is a cross-sectional view for showing a steam inlet, a torus part and a steam path ring of the nozzle box assembly according to the embodiment of the present disclosure, in which the steam inlet, the torus part and the steam path ring are coupled together.

FIG. 4 is a cross-sectional view showing the nozzle box assembly. With respect to the direction as shown in FIG. 4, the steam inlet 50, through which steam is introduced, is provided from top to bottom and the lower side end portion of the steam inlet 50 is connected to the upper side rear portion of the torus part 200. Further, the steam path ring 100 is provided in the right direction and a vane 110 is provided to the inside of the steam path ring 100.

Figure 5A:
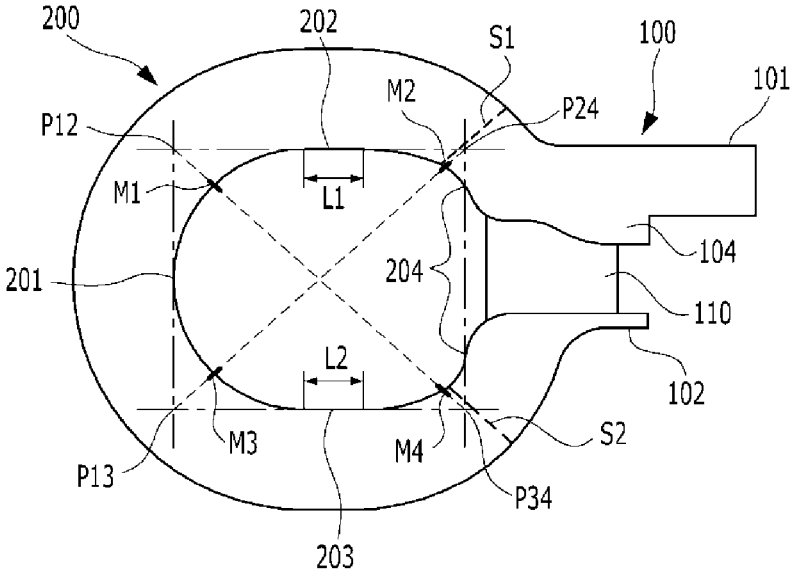
FIG. 5A and FIG. 5B show cross-sectional views of a torus part and a steam path ring, coupled with each other, of a nozzle box assembly according to embodiments of the present disclosure.
Figure 5B:
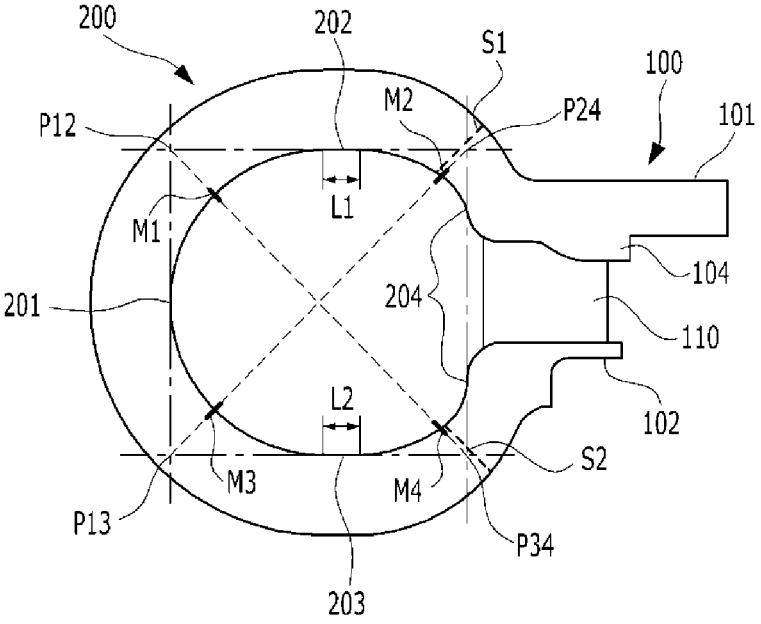

FIGS. 5A and 5B are cross-sectional views showing the nozzle box assembly according to the embodiment of the present disclosure, in which the torus part and steam path ring are coupled. FIGS. 5 illustrate each constituent element of the torus part 200 and the steam path ring 100 according to the present disclosure in detail.

As shown in FIG. 5, the torus part 200 and the steam path ring 100 are coupled with each other with respect to joint surfaces S1, S2.

First, the internal space of the torus part 200 in a state, in which the torus part 200 is coupled with the steam path ring 100, includes a rear surface 201 at the opposite side of an opening portion, an upper inner surface 202 representing an upper surface in the internal space, which is formed in an annular cross-section shape, a lower inner surface 203 representing a lower surface in the internal space of the annular cross-section shape, and a front surface 204 provided with the opening portion, as shown in FIG. 5.

Herein, the rear surface 201, the upper inner surface 202, the lower inner surface 203 and the front surface 204, which form the internal space of the torus part 200, include curved surfaces and are continuously formed from each other. Therefore, for convenience's sake, each of these surfaces are defined as to where it positions. According to the present disclosure, the rear surface 201, the upper inner surface 202, the lower inner surface 203 and the front surface 204 are defined by a virtual circumscribed quadrilateral of the internal space of the torus part 200 and four positions M1, M2, M3 and M4, at which diagonal lines (dotted lines) extending from the peak points P12, P13, P34 and P24 of the virtual circumscribed quadrilateral intersect the inner surface of the torus part 200.

In the structure of the nozzle assembly box according to the present disclosure, it is important that each of the upper inner surface 202, the lower inner surface 203 and the front surface 204 includes a straight section rather than a curved surface (a circumferential surface) or a section, which is close to a straight line, that is, a radius of curvature of which is large, and the description thereof will be followed hereinafter.

Meanwhile, regarding the vertical relations of the upper inner surface and the lower inner surface, the vertical direction is defined with respect to the cross-section of the upper side half in the annular shape as shown in FIG. 5, wherein the vertical positions of the corresponding parts of the lower side half in the annular shape, which is not shown, shall be defined inversely.

Working steam of high temperature and high pressure is supplied through the steam inlet 50, and the torus part 200 forms an annular steam path connected to the steam inlet 50. Further, the opening portion included in a part of the front surface 204 is connected to the steam path ring 100, which is provided with a plurality of vanes 110, and thus a path is provided such that the steam can be injected to a stage through this path.

According to a related art nozzle box assembly, a bridge ring is provided for connecting a torus part to a steam path ring. However, the nozzle box assembly according to the present disclosure is structured, in which such a bridge ring is omitted and the steam path ring 100 is directly connected to the opening portion of the torus part 200.

Speaking more specifically, the front surface 204 of the torus part 200 is formed in a shape, which coincides with a straight line connecting two peaks P24 and P34, which define the front surface, among the four peaks of the rectangle, or in a shape which is sharply bent from the upper inner surface 202 and the lower inner surface 203 so as to be close to a straight line. This shape is to secure a thickness for the direct connection between the torus part 200 and the steam path ring instead of removing the bridge ring.

As mentioned hereinbelow, the torus part 200 and the steam path ring 100 are connected to each other by welding, bolting, flange connection and the like and, in order to secure the connection, each of the opened surface of the torus part 200, which forms the front surface 204, and the connection portion of the steam path ring 100 has to be formed of a thickness enough to secure an appropriate structural strength. Therefore, the front surface 204 of the torus part 200 may be sharply bent as the illustrated shape since a sufficient thickness might not be obtained by smoothly bending the front surface 204 of the torus part 200 with the same radius as the rear surface 201 from the upper inner surface 202 and the lower inner surface 203.

If the shape of the front surface 204 is designed for directly connecting the torus part 200 to the steam path ring 100 as described above, the steam flow towards the vane 110 can be obstructed with bad influence on the flow characteristics thereof. In order to compensate the defect, according to the present disclosure, straight sections L1 and L2 are respectively formed of a predetermined length in the middle of the upper inner surface 202 and the lower inner surface 203 of the torus 200, that is, the surfaces for connecting the rear surface 201 to the front surface 204. That is, the flow efficiency of the steam, which is discharged to the steam path ring 100, is improved by increasing the straight flow paths, through which the steam introduced through the steam inlet 50 flows to the steam path ring 100, and decreasing the height in the vertical direction.

It is preferable that the straight sections L1 and L2 respectively have lengths in the range of about 20~50% of the entire lengths of the upper inner surface 202 and the lower inner surface 203. Herein, FIG. 5(*a*) is a cross-sectional view of a nozzle box assembly designed for a steam turbine of 500 MW, and FIG. 5(*b*) is a cross-sectional view of a nozzle box assembly designed for a steam turbine of 1000 MW. Comparing the nozzle box assemblies of these two specifications, it can be understood that the lengths of the straight sections L1 and L2 are decreased in inverse proportion to the size of the torus part 200 because the steam flow path formed by the internal space of the torus part 200 becomes long if the size of the torus part 200 is increased and thus the lengths of the straight sections L1 and L2 can be decreased. Therefore, it is possible to design the lengths of the straight sections L1 and L2, which occupy 20~50% of the entire lengths of the upper inner surface 202 and the lower inner surface 203, in inverse proportion to the size of the torus part 200 or the radius of curvature of the circumferential surface which forms the rear surface 201.

Meanwhile, the front surface 204 has an upper joint surface S1 and a lower joint surface S2, which are coupled with the steam path ring 100, wherein it is preferable that the end portion of the upper joint surface S1 rather than the end portion of the lower joint surface S2 is positioned to be more adjacent to the rear surface 201. Because the torus part 200 and the steam path ring 100 can incur mutual interference when the torus part 200 and the steam path ring 100 are coupled with each other in the case where each of the end portions of the upper joint surface S1 and the lower joint surface S2 is provided at the same position.

Herein, the upper joint surface S1 and the lower joint surface S2 refer to an upper portion and a lower portion with respect to FIG. 5 and may respectively mean the outside and the inside of the ring with respect to the entire shape of the ring which has a predetermined thickness.

Figure 6:
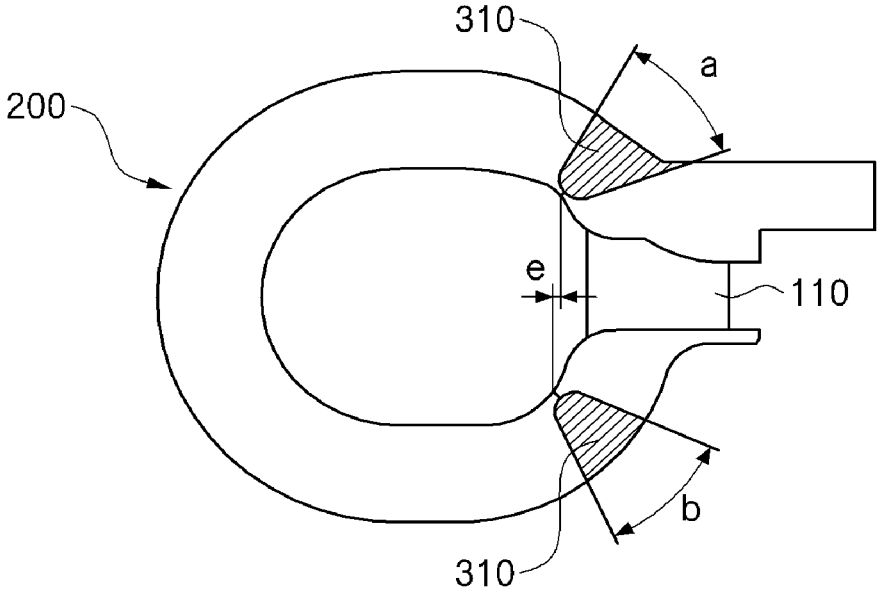
FIG. 6 is a conceptual diagram illustrating welding coupling according to an embodiment of the present disclosure, in which a torus part and a steam path ring of a nozzle box assembly are coupled by welding.
Figure 7:
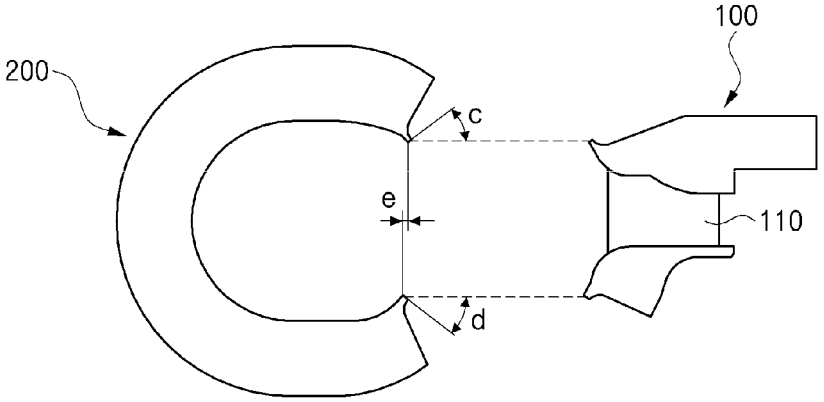
FIG. 7 is an exploded view illustrating the welding coupling of the torus part and the steam path ring of the nozzle box assembly according to the embodiment of the present disclosure.

FIG. 6 and FIG. 7 show structures, in which the torus part 200 and the steam path ring 100 are directly connected to each other and a mutual interval "e" is formed between the end portion of the upper joint surface S1 and the end portion of the lower joint surface S2 as shown in FIG. 6. The interval "e" references a horizontal interval, by which each of the end portions of the upper joint surface S1 and the lower joint surface S2 is offset with respect to the horizontal direction, wherein it is preferable that the value of the interval "e" is about 1/100 or more and 1/50 or less of the length of the upper inner surface. The interference, which may be possibly generated when the torus part 200 and the steam path ring 100 are coupled with each other, can be reduced or prevented by forming the horizontal interval "e" as above.

Considering the welding shape of the torus part 200 and the steam path ring 100 in more detail, a torus part 200 side welding surface and a steam path ring 100 side welding surface in the upper joint surface S1 form an angle a with respect to each other and it is preferable that the angle a is formed in the range of 35~45 degrees.

In addition, a torus part 200 side welding surface and a steam path ring 100 side welding surface in the lower joint surface S2 form an angle b with respect to each other and it is preferable that the angle b is formed in the range of 35~40 degrees.

Meanwhile, as shown in FIG. 7, the virtual center line between the torus part 200 side end portion and the steam path ring 100 side end portion at the upper side, that is, the upper joint surface S1 has a value representing an upper horizontal angle c of the entire welding surface, and this upper horizontal angle c is preferably to be 35~45 degrees. Similarly, the upper joint surface S2, which is formed by the torus part 200 side end portion and the steam path ring 100 side end portion at the lower side, forms an upper horizontal angle d, which is preferably to be 40~50 degrees.

The steam path ring 100 has an upper body 101 and a lower body 102 which are respectively concentric with the center of nozzle box assembly and connected to the torus part 200. Herein, it may be worth consideration that the inner surface of the upper body 101 is provided with a stepped portion 104, which becomes narrow in a steam outlet side direction. If the stepped portion 104 is formed on the inner surface of the upper body 101 as above, the flow rate of the steam is increased at the trailing edge of the vane 110, helping the improvement of the flow characteristics.

Figure 8:
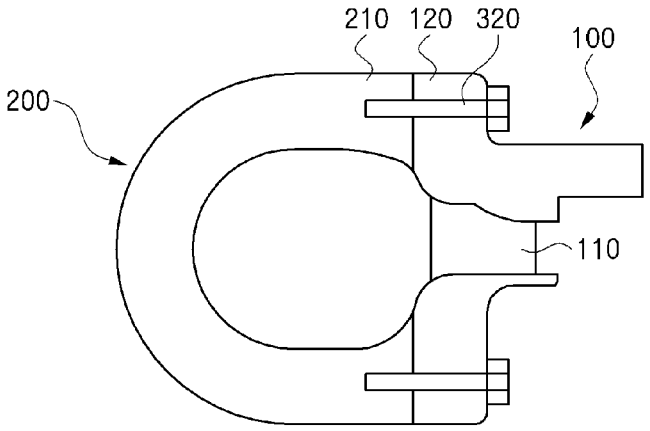
FIG. 8 is a conceptual diagram illustrating inner flange coupling according to an embodiment of the present disclosure, in which a torus part and a steam path ring of a nozzle box assembly are coupled by the inner flange.

Meanwhile, FIG. 8 shows a coupling structure of the torus part and the steam path ring by bolting. As shown in FIG. 8, the front surface of the torus part 200 and the rear surface of the steam path ring 100 are respectively provided with a plurality of bolting holes, and bolts 320 are coupled in the bolting holes such that the torus part 200 and the steam path ring 100 can be coupled with each other. This coupling structure using bolting connection is enabled since the bridge ring which has been interposed between the torus part 200 may be omitted in the present disclosure and thus more uniform surface pressure can be readily formed. FIG. 8 illustrates an embodiment of the present disclosure, in which an outwardly folded flange 120 is provided to the steam path ring 100 such that a bolt is inserted to the inside of a front end portion 210 of the torus part 200.

Such a bolt-connection structure as described above can largely increase the working efficiency, compared with a welding structure, and is very advantageous in terms of maintenance. In addition, it may be also worth consideration that the bolt connection and welding may be simultaneously applied so as to further increase the structural stability of the coupling portion.

Figure 9:
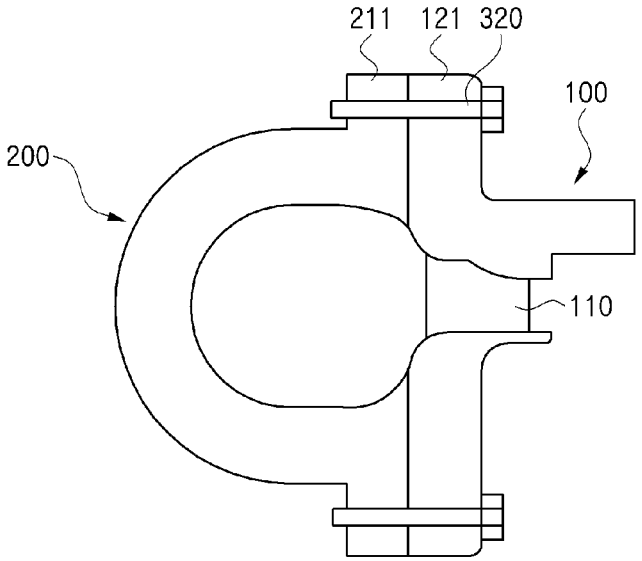
FIG. 9 is a conceptual diagram illustrating outer flange coupling according to an embodiment of the present invention, in which a torus part and a steam path ring of a nozzle box assembly are coupled by the outer flange.

Meanwhile, FIG. 9 shows another embodiment of the present disclosure, in which outwardly protruded flanges 211 and 121 are provided to both of the torus part 200 and the steam path ring 100 for bolt connection.

The flanges 120, 121 and 211 as illustrated in FIG. 8 and FIG. 9 carry out functions of forming support bodies for the bolt coupling as well as structurally reinforcing the nozzle box assembly. That is, each of the flanges forms a ring structure of a thickness equal to the protrusion length thereof on the nozzle boxy assembly such that the nozzle box assembly can be structurally reinforced by the thickness.

Figure 10:
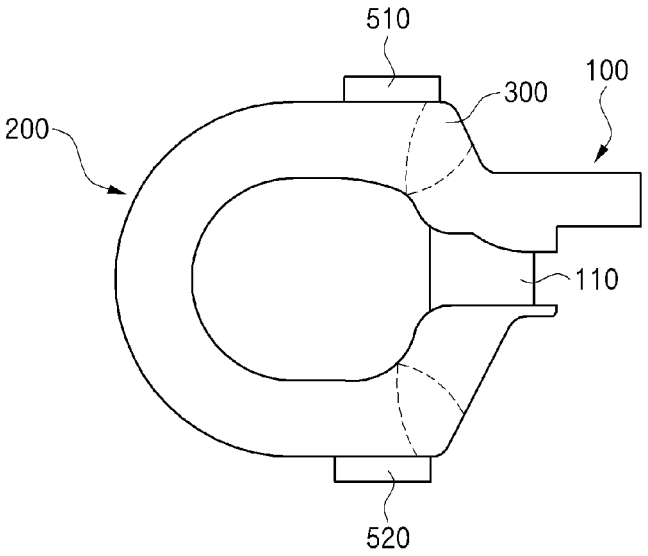
FIG. 10 is a conceptual diagram illustrating retaining rings provided to a torus part of a nozzle box assembly, according to an embodiment of the present disclosure.

Meanwhile, FIG. 10 shows a retaining ring, which is provided to the torus part 200. Retaining rings 510 and 520 refer to ring structures, which come into close contact with and thus encompass the outer surface of the torus part 200. The retaining rings 510, 520 can be formed as the upper retaining ring 510 provided to the outside of the torus part 200 at the upper portion thereof and/or the lower retaining ring 520 provided to the outside of the torus part 200 at the lower portion thereof, as shown in FIG. 10. The retaining rings 510, 520 are provided to restrain the expansion of the torus part 200 due to the pressure of the steam, wherein it is also possible to provide either or both of the upper retaining ring 510 and the lower retaining ring 520. Herein, the upper portion and the lower portion are divided with respect to FIG. 10, and may be represented as an inner portion and an outer portion with respect to the entire annular torus part 200.

It is also possible to provide at least two or more retaining rings 510, 520 into a divided shape so as to connect and fix the divided end portions thereof to each other by welding or using any additional coupling. The retaining rings 510, 520 can be applied to the welding coupling structure as shown in FIG. 6 as well as the flange coupling structures as shown in FIG. 8 and FIG. 9. The retaining ring can be provided to the end portion of the front surface of the torus part 200 in the embodiment of FIG. 8 and can be provided to the left side of the flange of the torus part 200 in the embodiment of FIG. 9. In addition, the retaining rings can be provided to the outside of the steam path ring 100 as well as the torus part 200 in accordance with circumstances.

Figure 11:
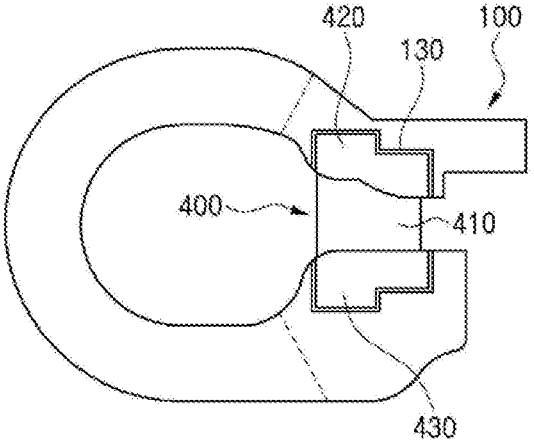
FIG. 11 is a conceptual diagram illustrating a steam path ring and an inner vane divisional body thereof in a nozzle box assembly according to an embodiment of the present disclosure.
Figure 12:
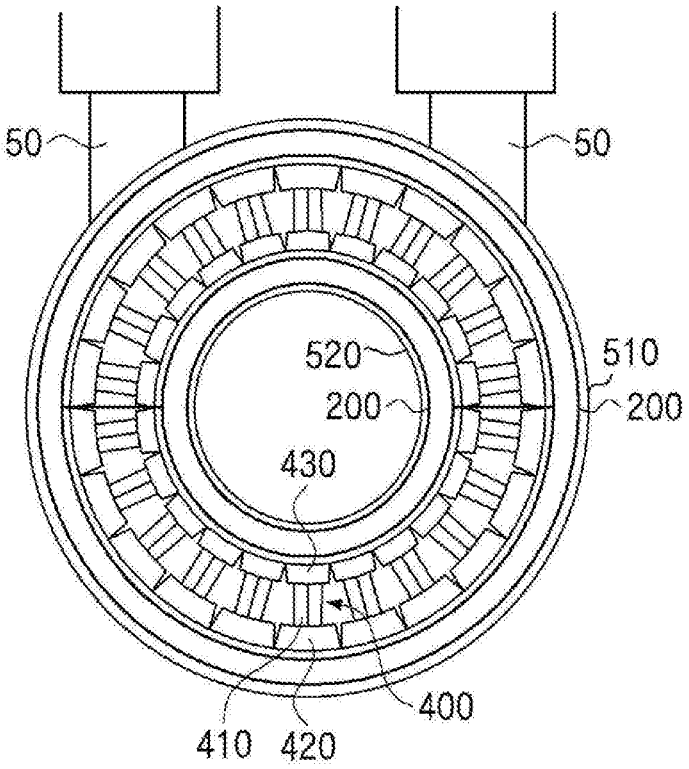
FIG. 12 is a front view illustrating a state, in which vane divisional bodies are provided to a steam path ring of a nozzle box assembly according to an embodiment of the present disclosure.

Meanwhile, FIG. 11 shows a cross-sectional view for showing a vane 410 in a divided shape, and FIG. 12 corresponds to a front view for showing a state, in which the vane 410 in the divided shape is coupled with the steam path ring 420.

As shown in FIG. 12, the vane 410 coupled with the steam path ring 420 has a shape, in which a plurality of divisions is spaced from each other at a predetermined circumference angle.

As shown in FIG. 11, an upper holder part 420 and a lower holder part 430 are respectively provided to the inside and the outside of the vane 410 in the divided shape such that the vane 140 can be fixed. The upper holder part 420 and the lower holder part 430 of the vane 410 are fitted and fixed in the circumferential direction on guide parts 130, which are provided to the upper body 101 and the lower body 102 of the steam path ring 100 into shapes corresponding to those of the upper and lower holder parts 420 and 430.

The vane 410 in the divided shape as described above can be conveniently manufactured with a reduced material loss, compared with the related art vane which is cut into a semicircular ring shape integrally with the steam path ring 100. In addition, there is an advantage that, if some of the vanes 410 are damaged, such a damaged part can be separately replaced. Even though there is a slight disadvantage in the structure in terms of restraining the expansion of the steam path ring 100 if the vane 410 is provided as a divisional body as described above, the structural strength can be reinforced by applying the retaining rings 510 and 520 as described above.

Hereinabove, even though all the constituent elements which form the embodiments of the present disclosure may be coupled as a single body or operating as a single body in combination, the present disclosure is not necessarily limited to these embodiments. That is, within the purpose of the present disclosure, one or more of all the constituent elements can be selectively coupled to operate. In addition, it should be understood that the terms of "include", "form" or "have" used hereinabove mean that corresponding constituent elements can be inherent, unless otherwise defined, and thus shall be construed as that any other constituent elements are not excluded but may be further included. All the terms including all technical and scientific terms have, unless otherwise defined, the same meaning as commonly understood by a person skilled in the art, to which the present disclosure belongs. The above description has been made to the technical idea of the disclosure by way of example, and it would be apparent to a person skilled in the art that various modifications and variations can be made without departing from the essential characteristics of the invention. Therefore, the embodiments described herein are not to limit but to simply illustrate the technical idea of the present disclosure and thus the scope of the technical idea of the present disclosure is not limited to such embodiments. Therefore, it would be understood that the technical and protective scope of the present disclosure shall be defined by the following claims and all modifications, changes and equivalences within the technical scope of the present disclosure defined by the following claims belong to the technical scope of the present disclosure.

What is claimed is:

1. A nozzle box assembly, comprising:

a torus part forming an annular steam path and having an opening portion communicating with at least one steam inlet through which working steam is supplied to the annular steam path, the opening portion formed in a front surface of the torus part between an upper joint surface of the torus part and a lower joint surface of the torus part;

a steam path ring that is configured to be coupled to a stage of a steam turbine and includes an upper body coupled directly to the upper joint surface and a lower body coupled directly to the lower joint surface, the upper and lower bodies configured to provide the working steam of the annular stream path to the stage of the steam turbine; and a plurality of airfoil vanes regularly spaced apart from each other so as to be arranged around a circumference of the steam path ring, each airfoil vane being discretely formed to have an upper holder that is fitted and fixed to the upper body of the steam path ring and a lower holder that is fitted and fixed to the lower body of the steam path ring, wherein the upper body of the steam path ring includes a first guide for receiving the upper holder, and the lower body of the steam path ring includes a second guide for receiving the lower holder, wherein each of the first and second guides is formed of a plurality of guide surfaces including a nozzle exit surface facing toward the torus part and encasing at least a portion of a steam outlet side of the upper and lower holders, and a stepped surface formed of two straight sides connected to each other by a transition side, the two straight sides respectively including a first guide surface and a second guide surface that is disposed downstream of the first guide surface and is closer to a steam outlet of the steam path ring than the first guide surface, and wherein the first and second guide surfaces of the first guide are disposed so as to be parallel to the first and second guide surfaces of the second guide, respectively.

2. The nozzle box assembly according to claim 1, wherein the torus part includes an upper inner surface, a lower inner surface and a rear surface with respect to a cross-section of the annular steam path, and the upper inner surface and the lower inner surface include straight sections.

3. The nozzle box assembly according to claim 2, wherein the straight sections respectively have lengths in the range of 20-50% of entire lengths of the upper inner surface and the lower inner surface.

4. The nozzle box assembly according to claim 3, wherein the lengths of the straight sections are formed in inverse proportion to a radius of curvature formed by the rear surface of the torus part.

5. The nozzle box assembly according to claim 2, wherein the front surface includes a straight section between the opening portion and the upper inner surface or between the opening portion and the lower inner surface.

6. The nozzle box assembly according to claim 1, wherein the lower body includes an inner surface that is substantially flat and communicates with a steam outlet of the steam path ring through which the working steam is discharged, and the upper body includes an inner surface that communicates with the steam outlet of the steam path ring and faces the inner surface of the lower body, and wherein the inner surface of the upper body includes a stepped portion, and the stepped portion narrows the steam outlet through which the working steam is discharged, the stepped portion including a downstream flat surface that communicates with the steam outlet of the steam path ring and an upstream flat surface disposed upstream of the downstream flat surface, each of the upstream and downstream flat surfaces being disposed substantially parallel to the inner surface of the lower body.

7. The nozzle box assembly according to claim 1, wherein the torus part and the steam path ring are coupled by welding.

8. The nozzle box assembly according to claim 7, wherein a torus part side welding surface and a steam path ring side welding surface of the upper joint surface and the lower joint surface form an angle in the range of 35-45 degrees.

9. The nozzle box assembly according to claim 8, wherein an upper horizontal angle formed by the upper joint surface is in the range of 35-45 degrees.

10. The nozzle box assembly according to claim 8, wherein a lower horizontal angle formed by the lower joint surface is in the range of 40-50 degrees.

11. The nozzle box assembly according to claim 1, wherein the front surface of the torus part and a rear surface of the steam path ring are respectively provided with a plurality of bolting holes into which bolts are coupled such that the torus part and the steam path ring are coupled.

12. The nozzle box assembly according to claim 1, wherein the torus part and the steam path ring respectively include flanges at connection portions thereof, and the flanges are coupled with each other by bolting.

13. The nozzle box assembly according to claim 1, further comprising a retaining ring operable to come into contact with and encompass an outside or inside of the torus part.

14. The nozzle box assembly according to claim 1, wherein the working steam passes from the annular steam path to the stage of the steam turbine by passing between a surface of one airfoil vane of the plurality of airfoil vanes and a surface of an airfoil vane adjacent to the one airfoil vane, and wherein each airfoil vane of the plurality of airfoil vanes is discretely formed as a divisional body including:

the upper holder, the lower holder, and a vane member that is coupled to the upper and lower holders and includes first and second surfaces respectively formed on opposite sides of the vane member, the opposite sides facing away from each other such that the first surface of the vane member of one airfoil vane of the plurality of airfoil vanes faces the second surface of the vane member of an adjacent airfoil vane of the plurality of airfoil vanes arranged around the circumference of the steam path ring, wherein the working steam passing from the annular steam path passes between the first and second surfaces of two adjacent airfoil vanes of the plurality of airfoil vanes.

15. The nozzle box assembly according to claim 1, wherein the working steam passes from the annular steam path to the stage of the steam turbine by passing between a surface of one airfoil vane of the plurality of airfoil vanes and a surface of an airfoil vane adjacent to the one airfoil vane, and wherein the working steam passing from the annular steam path passes through a space bounded by the surface of the one airfoil vane of the plurality of airfoil vanes and the surface of the airfoil vane adjacent to the one airfoil vane.

16. The nozzle box assembly according to claim 1, wherein the plurality of guide surfaces of the first and second guides consist entirely of straight sides connected to each other at right angles.

17. A nozzle box assembly, comprising:

a plurality of steam inlets operable to supply working steam therethrough;

a torus part coupled to the steam inlets so as to form an annular steam path and having an opening portion in which a part of the annular steam path is opened; and a steam path ring coupled to the opening portion so as to provide a path, which is coupled to a stage, and provided with a plurality of vanes, wherein the steam path ring is directly connected to the opening portion, wherein the torus part includes a front surface, an upper inner surface, a lower inner surface and a rear surface with respect to a cross-section of the annular steam path, and the upper inner surface and the lower inner surface include straight sections, wherein the front surface includes an upper joint surface and a lower joint surface, the upper joint surface and the lower joint surface are coupled with the steam path ring, and an end portion of the upper joint surface is disposed closer to the rear surface than an end portion of the lower joint surface.

18. The nozzle box assembly according to claim 17, wherein a horizontal interval between the upper joint surface and the lower joint surface is in the range of 1/100 to 1/50 of the length of the upper inner surface.

19. A nozzle box assembly, comprising:

a torus part forming an annular steam path and having an opening portion communicating with at least one steam inlet through which working steam is supplied to the annular steam path, the opening portion formed in a front surface of the torus part between an upper joint surface of the torus part and a lower joint surface of the torus part;

a steam path ring that is configured to be coupled to a stage of a steam turbine and includes an upper body coupled directly to the upper joint surface and a lower body coupled directly to the lower joint surface, the upper and lower bodies configured to provide the working steam of the annular stream path to the stage of the steam turbine; and a plurality of airfoil vanes regularly spaced apart from each other so as to be arranged around a circumference of the steam path ring, each airfoil vane being discretely formed to have an upper holder that is fitted and fixed to the upper body of the steam path ring and a lower holder that is fitted and fixed to the lower body of the steam path ring, wherein the working steam passes from the annular steam path to the stage of the steam turbine by passing between a surface of one airfoil vane of the plurality of airfoil vanes and a surface of an airfoil vane adjacent to the one airfoil vane, and wherein each of the upper joint surface and the lower joint surface has an end portion disposed toward the annular steam path of the torus part, and the end portion of the upper joint surface is disposed closer to a rear surface of the torus part than the end portion of the lower joint surface.

* * * * *